US011112074B2

(12) United States Patent
Kulkarni et al.

(10) Patent No.: US 11,112,074 B2
(45) Date of Patent: Sep. 7, 2021

(54) MOUNTING ARRANGEMENT FOR A FIXTURE HAVING A MOUNTING PLATE WITH WIRING AND DRIVING COMPARTMENT AND HOLES FOR ROPE TO BE THREADED THERETHROUGH

(71) Applicant: Appleton Grp LLC, Rosemont, IL (US)

(72) Inventors: Harish P. Kulkarni, Pune (IN); Timothy E. Graff, Arlington Heights, IL (US); Santosh K. Patil, Pune (IN)

(73) Assignee: Appleton Grp LLC, Rosemont, IL (US)

( * ) Notice: Subject to any disclaimer, the term of this patent is extended or adjusted under 35 U.S.C. 154(b) by 76 days.

(21) Appl. No.: 16/818,361

(22) Filed: Mar. 13, 2020

(65) Prior Publication Data

US 2020/0292142 A1 Sep. 17, 2020

(30) Foreign Application Priority Data

Mar. 16, 2019 (IN) ..... 201921010325

(51) Int. Cl.

| | |
|---|---|
| ***F21S 8/04*** | (2006.01) |
| ***F21V 29/508*** | (2015.01) |
| ***F21V 29/70*** | (2015.01) |
| ***F21S 8/06*** | (2006.01) |

(52) U.S. Cl.

CPC ..... *F21S 8/043* (2013.01); *F21S 8/061* (2013.01); *F21V 29/508* (2015.01); *F21V 29/70* (2015.01)

(58) Field of Classification Search

CPC .... F21S 8/043; F21S 8/046; F21S 8/06; F21S 8/061; F21S 8/063; F21S 8/065; F21S 8/066; F21S 8/068; F21Y 2115/10

See application file for complete search history.

(56) References Cited

U.S. PATENT DOCUMENTS

2018/0202637 A1* 7/2018 Sieczkowski ..... F21V 21/02

* cited by examiner

*Primary Examiner* — Robert J May

(74) *Attorney, Agent, or Firm* — McDonnell Boehnen Hulbert & Berghoff LLP

(57) ABSTRACT

A mounting arrangement for an LED fixture, said LED fixture having a holding plate and a driver housing, said arrangement comprising slots configured on said holding plate and on said housing for threading a cable therethrough, said cable is connected to a support during mounting said fixture.

10 Claims, 7 Drawing Sheets

MOUNTING ARRANGEMENT FOR A FIXTURE HAVING A MOUNTING PLATE WITH WIRING AND DRIVING COMPARTMENT AND HOLES FOR ROPE TO BE THREADED THERETHROUGH

RELATED APPLICATIONS

This application claims priority to Indian Patent Application No. 201921010325 entitled "A Mounting Arrangement for a Fixture" filed on Mar. 16, 2019, which is incorporated by reference herein in its entirety.

FIELD

The present disclosure relates to the field of mounting arrangements for fixtures.

BACKGROUND

The background information herein below relates to the present disclosure but is not necessarily prior art.

Conventionally, a fixture, for example, an LED fixture, is connected to an overhead support structure using a mounting bracket. The mounting bracket is connected to an operative top portion of the fixture such that the fixture is pivotably displaceable about the bracket. The bracket is then connected to the support structure using fasteners. In another approach, the fixture is provided with a safety rope which is threaded through a holding plate of the fixture and is then looped around an overhead support structure to suspend the fixture from the support structure. Many times, the fixture is provided with both the mounting bracket and the safety rope arrangement. To facilitate threading of the rope through the fixture, brackets are mounted on the holding plate of the fixture, typically at operative ends thereof. Slots are configured on the brackets to facilitate threading of the rope therethrough. Such brackets are mounted on the holding plate using fasteners. However, if the connection between the bracket and the holding plate gets loose, the holding plate may fall down whereas the brackets may remain hanging with the rope. Further, the safety rope is not passed through all the external elements mounted on the holding plate of the fixture. Thus, if the connection between any of the elements and the holding plate or the connection between the elements gets loose, the elements may fall down.

Therefore, there is felt a need of a mounting arrangement for a fixture that alleviates the aforementioned drawbacks of the conventional arrangements.

OBJECTS

Some of the objects of the present disclosure, which at least one embodiment herein satisfies, are as follows:

An object of the present disclosure is to provide a mounting arrangement that facilitates secure mounting of a fixture to an overhead support.

Another object of the present disclosure is to provide a mounting arrangement that safeguards external elements of a fixture.

Another object of the present disclosure is to provide a mounting arrangement that ensures safety of the fixture and of people working on the floor during mounting of the fixture.

Another object of the present disclosure is to provide a mounting arrangement that facilitates easy handling of a fixture during maintenance, replacement, mounting and removal of the fixture.

Other objects and advantages of the present disclosure will be more apparent from the following description, which is not intended to limit the scope of the present disclosure.

SUMMARY

The present disclosure envisages a mounting arrangement for a lighting fixture. The mounting arrangement comprises a holding plate, a wiring and driver compartment, and a first rope. The holding plate has a first end and a second end. A first hole and a second hole are configured at the respective end of the holding plate. The wiring and driver compartment is provided on the operative top surface of the holding plate. A first extension with a third hole defined therein, is provided on one side of the compartment while a second extension with a fourth hole defined therein is provided on the other side of the compartment. The first and the second extensions extend in a direction parallel to the length of the holding plate. A third extension extends in an operative vertical direction from the front wall of the compartment wherein a fifth hole is defined in the third extension. The first rope is removably threaded through the first hole, the third hole, and the fifth hole to form a first loop for securing to and hanging the lighting fixture from an overhead support structure.

In an embodiment, one end of the first rope is configured in the form of an eye-loop or an eye splice.

In an embodiment, the first rope forms a second loop around the support structure for gripping the support structure.

In an embodiment, a plurality of fins is provided on the wiring and driver compartment for dissipating heat generated by the driver.

In an embodiment, the lighting fixture includes rails defined on the operative bottom surface of the holding plate and these rails are configured to receive linearly re-locatable sliding brackets for suspending the fixture.

In an embodiment, a second rope similar to the first rope is threaded through the second hole, the fourth hole, and the fifth hole for securing to and hanging the fixture to the support structure.

In an embodiment, one end of the first rope and the second rope includes a locking arrangement in the form of a locking rope-clip connected to it for firmly gripping and hanging the fixture to the support structure.

In an embodiment, a mounting bracket is fitted on the compartment in an offset manner from the center of the compartment, such that the mounting bracket is pivoted to the compartment along an axis parallel to the length of the holding plate.

In an embodiment, the mounting bracket includes a plurality of curved slots configured thereon to receive bolts pre-installed in the compartment.

In an embodiment, the material for the holding plate, the compartment, and the mounting bracket is selected from the group consisting of aluminium and stainless steel.

BRIEF DESCRIPTION OF THE ACCOMPANYING DRAWING

A mounting arrangement for a fixture, of the present disclosure, will now be described with the help of the accompanying drawing, in which.

LIST OF REFERENCE NUMERALS

Figure 1:
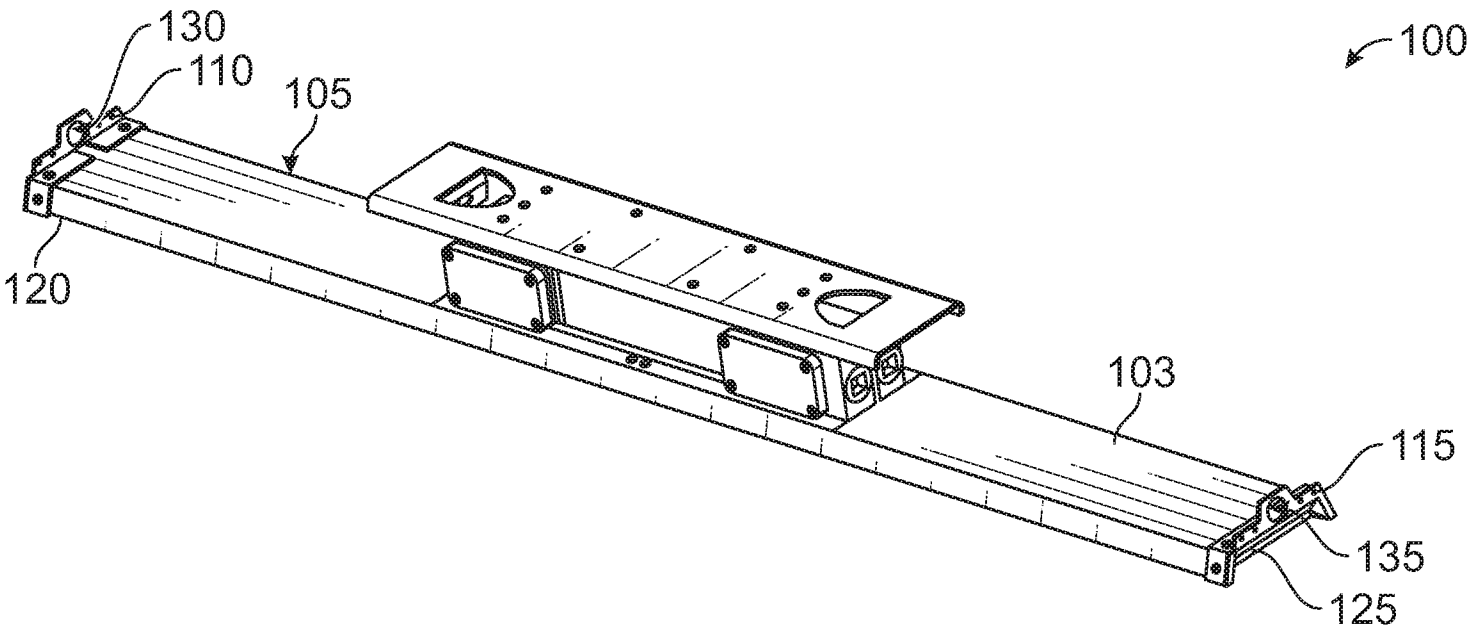
FIG. 1 (Prior Art)
FIG. 1 illustrates an isometric view of a conventional mounting arrangement for a fixture.

100—Conventional arrangement
103—Holding plate
105—Conventional lighting fixture
110, 115—Brackets
120, 125—Operative ends of the brackets
130, 135—Holes
200—Mounting arrangement of the present disclosure
205—Lighting fixture
210—First Hole
215—Second Hole
220—First operative end of the holding plate
225—Second operative end of the holding plate
230—Holding plate
235—Rope
240—Support structure
245—Driver housing
250, 255, 260—Extensions
265—Loop
270—Locking arrangement
300, 310—Mounting bracket
302—Curved slots
305—Central axis
315—Rails

DETAILED DESCRIPTION

Embodiments, of the present disclosure, will now be described with reference to the accompanying drawing.

Embodiments are provided so as to thoroughly and fully convey the scope of the present disclosure to the person skilled in the art. Numerous details, are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a", "an", and "the" may be intended to include the plural forms as well, unless the context clearly suggests otherwise. The terms "comprises", "comprising", "including", and "having" are open ended transitional phrases and therefore specify the presence of stated features, integers, steps, operations, elements, modules, units and/or components, but do not forbid the presence or addition of one or more other features, integers, steps, operations, elements, components, and/or groups thereof. The particular order of steps disclosed in the method and process of the present disclosure is not to be construed as necessarily requiring their performance as described or illustrated. It is also to be understood that additional or alternative steps may be employed.

When an element is referred to as being "mounted on", "engaged to", "connected to", or "coupled to" another element, it may be directly on, engaged, connected or coupled to the other element. As used herein, the term "and/or" includes any and all combinations of one or more of the associated listed elements.

The terms first, second, third, etc., should not be construed to limit the scope of the present disclosure as the aforementioned terms may be only used to distinguish one element, component, region, layer or section from another component, region, layer or section. Terms such as first, second, third etc., when used herein do not imply a specific sequence or order unless clearly suggested by the present disclosure.

Terms such as "inner", "outer", "beneath", "below", "lower", "above", "upper", and the like, may be used in the present disclosure to describe relationships between different elements as depicted from the figures.

FIG. 1 illustrates a conventional arrangement 100 for mounting a fixture 105 to an overhead support (not shown in figures). The arrangement 100 includes brackets 110, 115 mounted on operative ends 120, 125 respectively of a holding plate 103 of the fixture 105. Slots 130, 135 are configured on the brackets 110, 115 as shown in FIG. 1. A first rope (not specifically shown in FIG. 1) is passed through one slot, either the slot 130 or the slot 135, and is further looped around the overhead structure. A second rope (not specifically shown in FIG. 1) is passed through the other slot and is further looped around the overhead structure. In this way, the fixture 105 is suspended from the support structure. However, if the connection between the brackets 110, 115 and the holding plate 103 gets loose, the holding plate 103 may fall down whereas the brackets 110, 115 may remain hanging with the rope. Further, the safety rope is not passed through all the external elements mounted on the holding plate 103 of the fixture 105. Thus, if the connection between any of the elements and the holding plate 103 or the connection between the elements gets loose, the elements may fall down.

The present disclosure envisages a mounting arrangement that secures a fixture to an overhead support structure and alleviates the drawbacks of the conventional arrangement.

The mounting arrangement, of the present disclosure, is now described with reference to FIG. 2 through FIG. 8.

The mounting arrangement may comprise a plurality of holes or slots configured on element (s) of a fixture through which rope(s) or cable(s) is/are threaded. The ropes or cables are then looped around a support structure to secure the fixture to the support structure.

Figure 2:
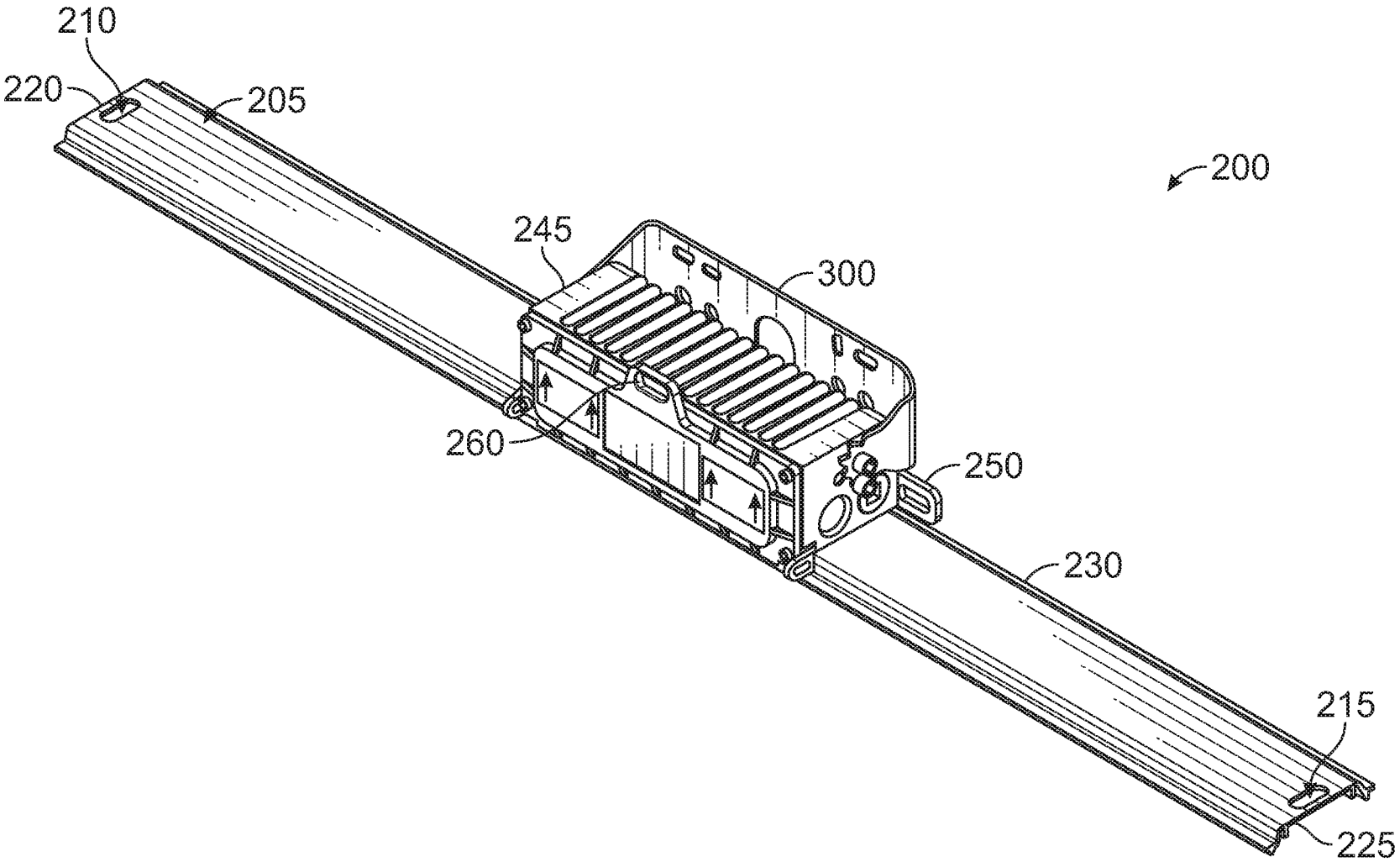
FIG. 2 illustrates an isometric view of the mounting arrangement configured on a fixture, in accordance with an embodiment of the present disclosure.
Figure 3:
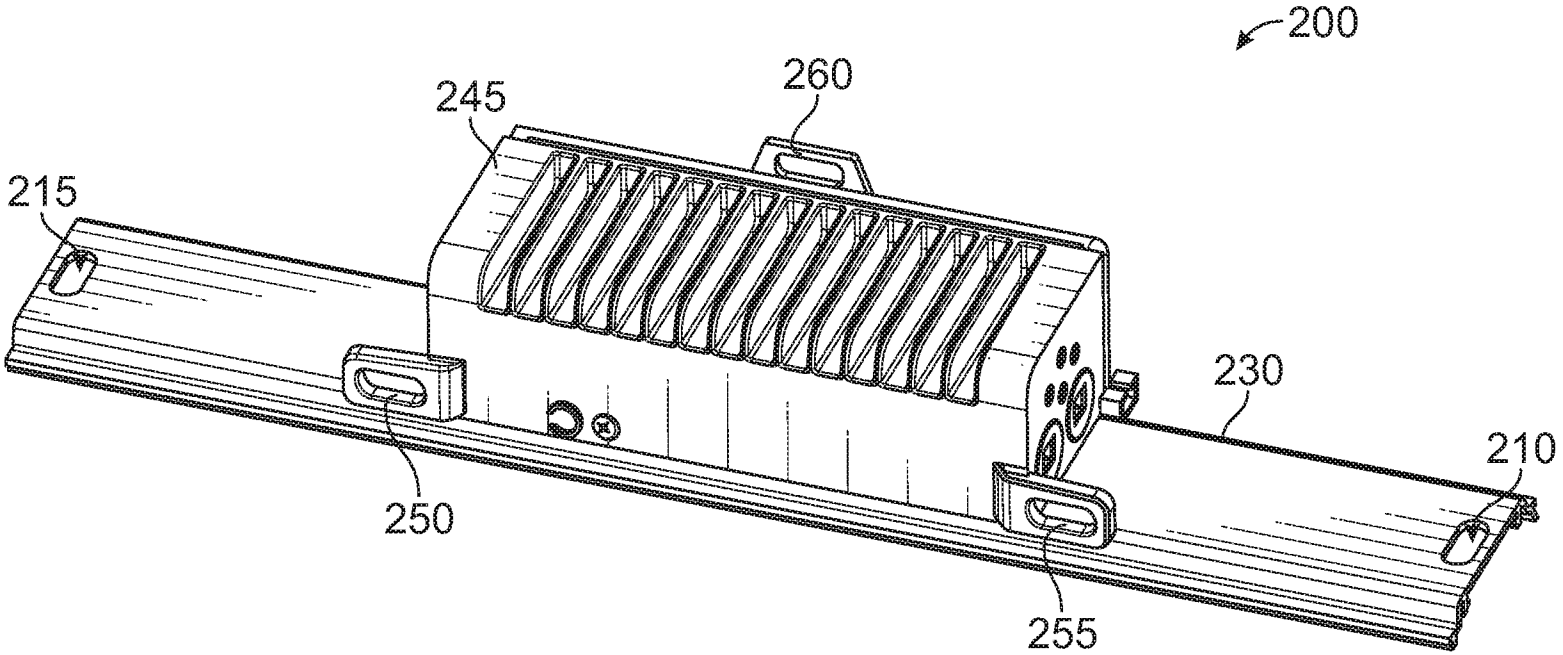
FIG. 3 illustrates another isometric view of the mounting arrangement of FIG. 2.
Figure 4:
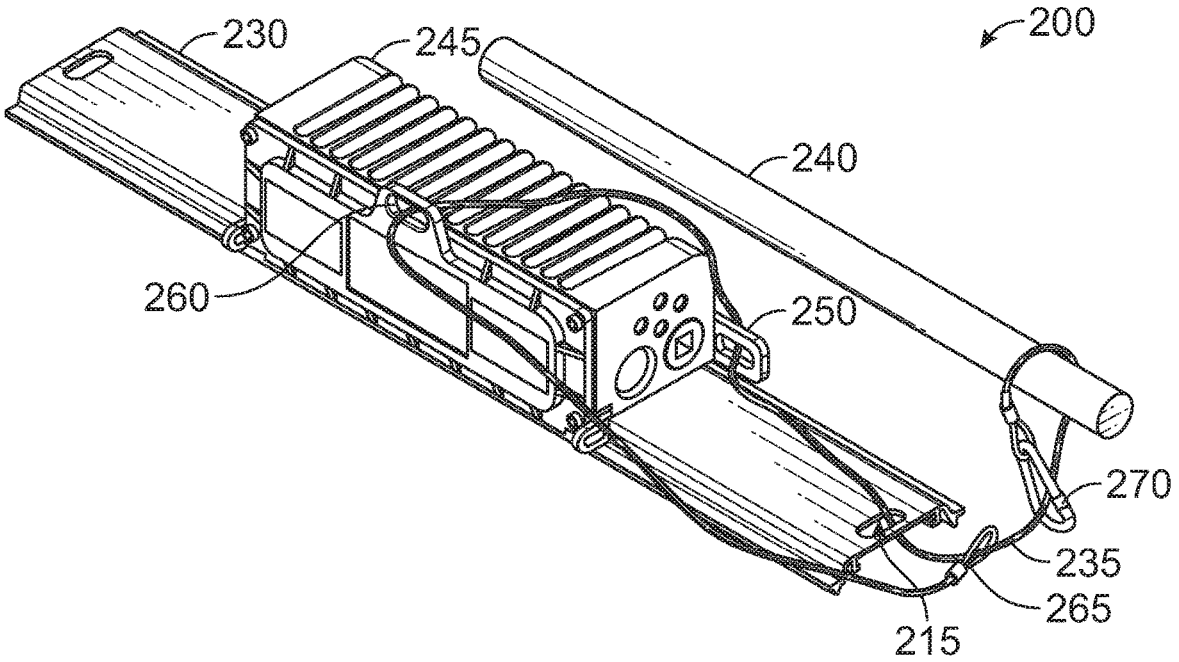
FIG. 4 illustrates an isometric view of the mounting arrangement of FIG. 2 depicting a rope threaded through a fixture and looped around a support structure.

Referring to FIG. 2 to FIG. 4, a mounting arrangement 200 in accordance with an embodiment is shown. The mounting arrangement 200 may comprise a pair of slots 210, 215 configured on a fixture 205 respectively.

A first hole 210 and a second hole 215 are configured at any suitable location on the fixture 205. In an embodiment, the first hole 210 and the second hole 215 are configured near the first and second operative ends 220, 225 of the holding plate 230 of the fixture 205.

The size and shape of the holes or slots 210, 215 are determined as per the dimensions of the rope/cable that is to be threaded through the holes or slots 210, 215.

The mounting arrangement 200 may further comprise ropes 235. Each of the ropes 235 is configured to be passed through the holes or slots 210, 215. To mount the fixture 205, the ropes 235 are threaded through the holes or slots 210, 215, and are further looped around a support structure 240 to which the fixture 205 is to be connected or from which the fixture 205 needs to be suspended.

The mounting arrangement 200 is configured to facilitate mounting of any fixture. In an embodiment, the fixture 205 is an LED fixture. The fixture 205 comprises the holding plate 230 and a wiring and driver compartment 245 mounted on the holding plate 230.

The mounting arrangement 200 may further comprise a plurality of provisions. The provisions are provided with holes or slots configured thereon to facilitate passing of the ropes therethrough. The provisions may be provided on the elements of the fixture 205 other than the holding plate 230. In an embodiment, the provisions are in the form of slotted extensions 250, 255, 260 as shown in FIG. 2, FIG. 3 and FIG. 4. In case of an LED fixture, the slotted extensions 250, 255, 260 are connected to the wiring and driver compartment 245. For fixtures other than the LED fixture, the provisions in the form of extensions may be provided on other elements of the fixture.

In another embodiment, the provisions are in the form of holes or slots configured on the other elements of the fixture.

In an embodiment, for LED fixture 205, as shown in FIG. 3, the slotted extensions 250, 255 may be configured on either sides of the wiring and driver compartment 245. The slotted extension 260 may be configured on a side of the wiring and driver compartment 245. The slotted extensions 250, 255 can be configured in any orientations on walls of the wiring and driver compartment 245.

For mounting the fixture 205, the ropes are threaded through the slots 210, 215 on the holding plate 230 as well as the slots on the slotted extensions 250, 255, 260. The ropes 235 are then looped around the support structure 240. The rope 235 can be threaded and looped around the support structure 240 in any suitable configuration. In one such configuration, as shown in FIG. 4, a first end of the rope 235 is threaded through the slot 215 and the slots configured on the slotted extensions 250 and 260. After passing through the slots, a smaller loop 265 of the rope 235 is formed at the first end through which the second end of the rope 235 is passed. The second end of the rope 235 is then looped around the support structure 240. The second end of the rope 235 is then provided with a locking arrangement 270 to lock the rope 235 with the support structure 240. In an embodiment, the locking arrangement 270 can be a locking rope clip. The other rope (not specifically shown in Figures) may be threaded through the slot 210 and the slots configured on the slotted extensions 255 and 260 in a similar manner. It is to be noted that the arrangement of the rope 235 and the slotted extensions 250, 255, 260 shown in FIGS. 2 to 4 are only for explanation purpose, and do not limit the scope and ambit of the present disclosure.

In an embodiment, the support structure 240 may be a part of the ceiling or may be the ceiling itself from which the fixture 205 is suspended or to which the fixture 205 is connected.

The slot and rope arrangement described above does not require any additional brackets to be mounted on the fixture 205. Further, as the rope 235 is threaded through all the elements of the fixture 205, i.e., the holding plate 230 and the housing 245, the elements of the fixture 205 are secured even if connection between them gets loose.

Figure 5:
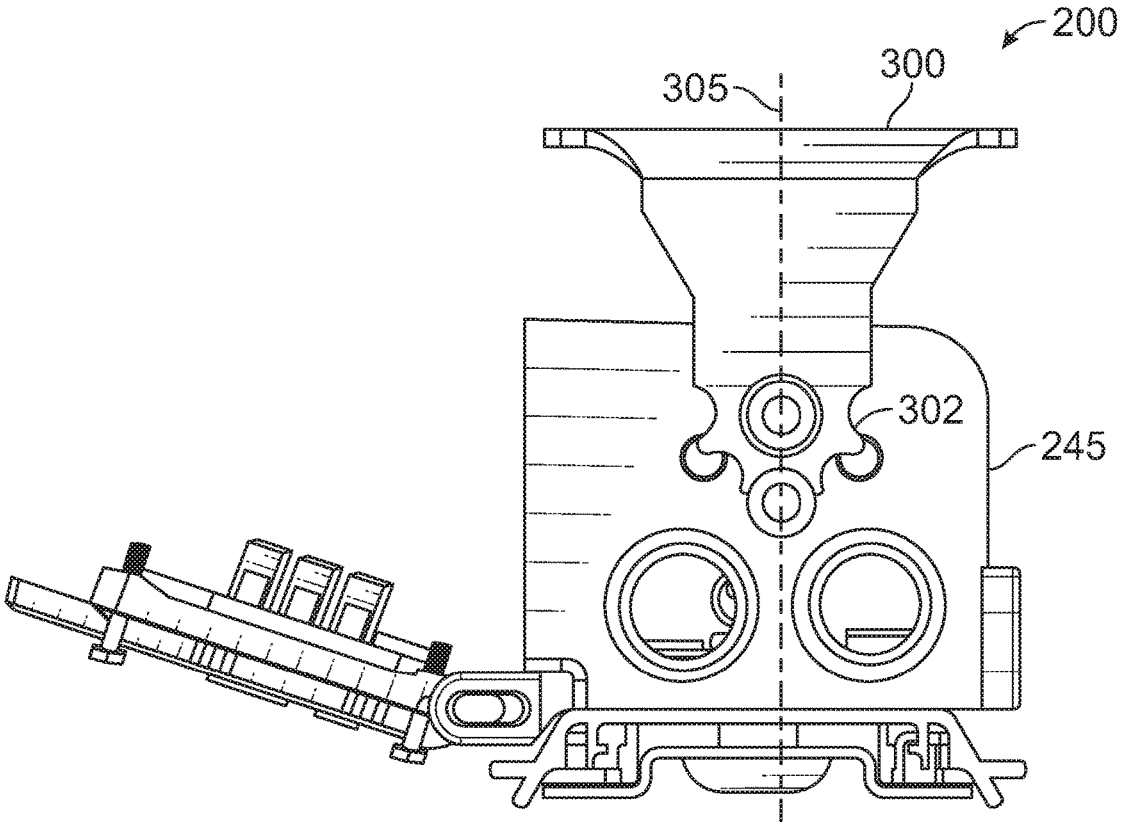
FIG. 5 illustrates a side view of a fixture depicting a mounting bracket of the mounting arrangement, in accordance with an embodiment of the present disclosure.
Figure 6:
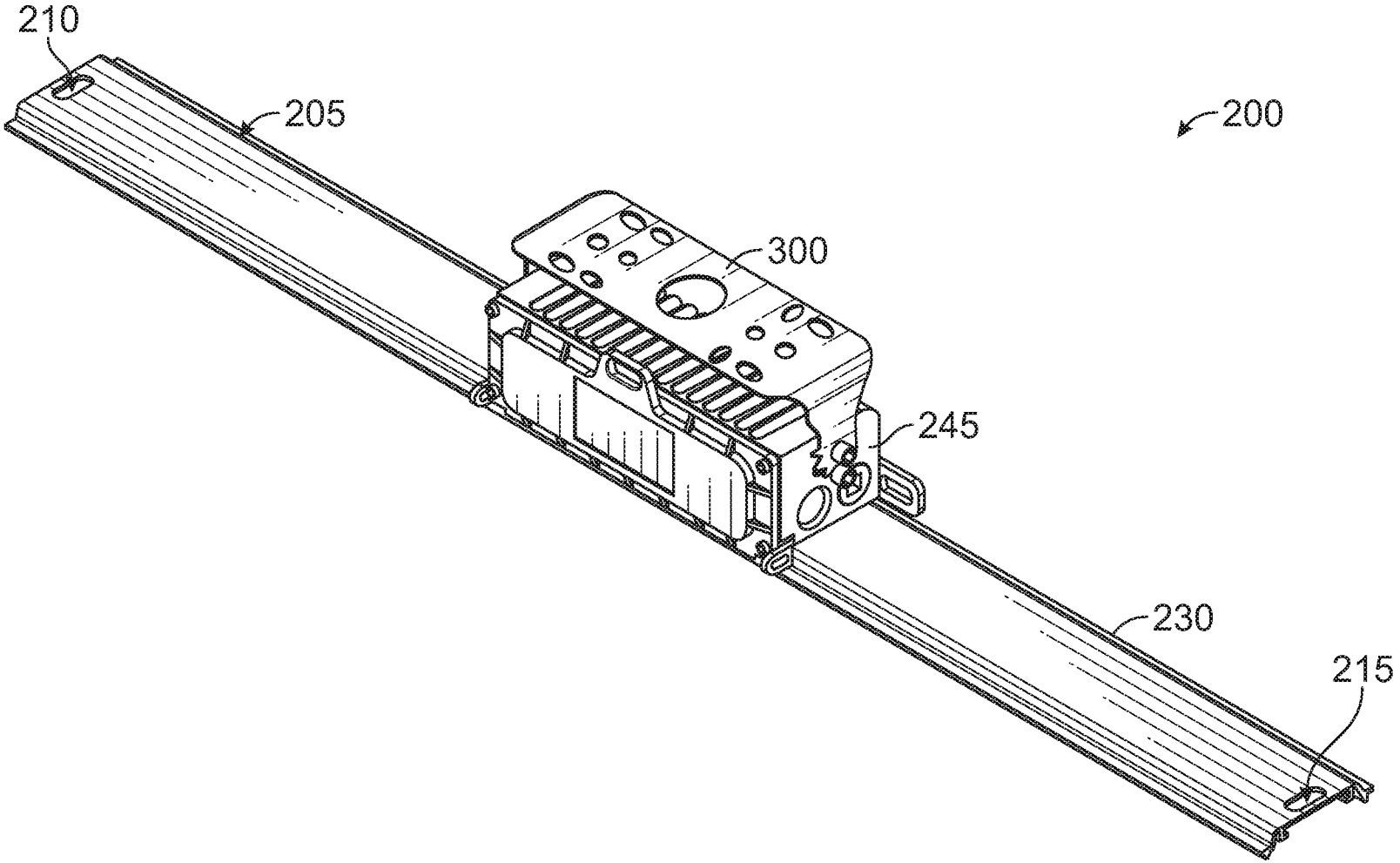
FIG. 6 illustrates an isometric view of a fixture depicting the mounting bracket of FIG. 5.

Referring to FIG. 2, FIG. 5, and FIG. 6, another embodiment of the mounting arrangement 200 is shown. The mounting arrangement 200 may comprise a mounting bracket 300 mounted on the housing 245 of the fixture 205. In an embodiment, the mounting bracket 300 is configured to facilitate mounting of the fixture 205 to the support structure 240.

In an embodiment, the mounting bracket 300 is mounted on the housing 245 offset from the central axis of the fixture 205. A side view of the housing 245 is shown in FIG. 5. The mounting bracket 300 is mounted on the housing 245 at a location which is offset from the central axis 305 or the center of the side wall to which the bracket 300 is connected.

The bracket 300 can be connected to the housing 245 using fasteners such that the housing can be angularly displaced about the joint of the housing 245 and the bracket 300. The offset arrangement of the bracket 300 reduces the overall height of the fixture 205, and at the same time, facilitates 90' swivel of the bracket 300 about the housing 245. More specifically, the arrangement of offset bracket 300 requires lower height of the housing 245 as compared to centrally arranged bracket on the housing. In the offset bracket arrangement, the distance between center of the bracket and one edge of the housing is reduced. Thus, the bracket can be easily swiveled about that edge of the housing with reduced height of the housing.

In an embodiment, the fixture is provided with both the bracket 300 and the rope and slot arrangement. In another embodiment, the fixture 205 is provided with either the bracket 300 or the rope and slot arrangement.

In another embodiment, the bracket 300 has curved slots 302 configured to receive bolts pre-installed on the housing 245. Once the bracket 300 is mounted on the housing 245, the bolts are tightened to secure the housing 245 to the bracket 300. The curved slots 302 eliminate the need of internally threaded holes on the bracket. Further, the curved slots 302 facilitate the position for locking of the bracket 300 at a predefined angle.

Figure 7:
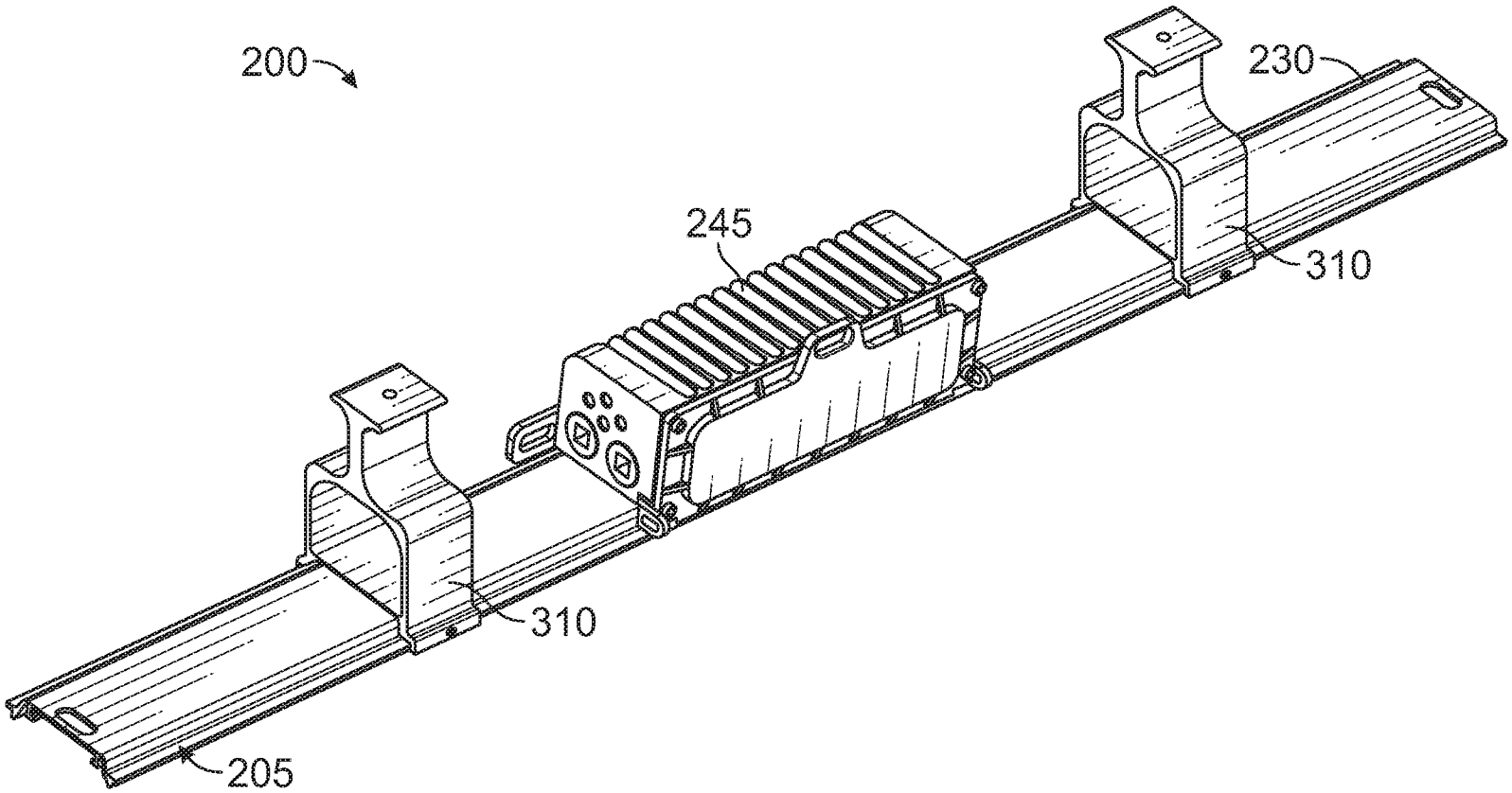
FIG. 7 illustrates an isometric view of a fixture depicting a mounting bracket of the arrangement, in accordance with an embodiment of the present disclosure.
Figure 8:
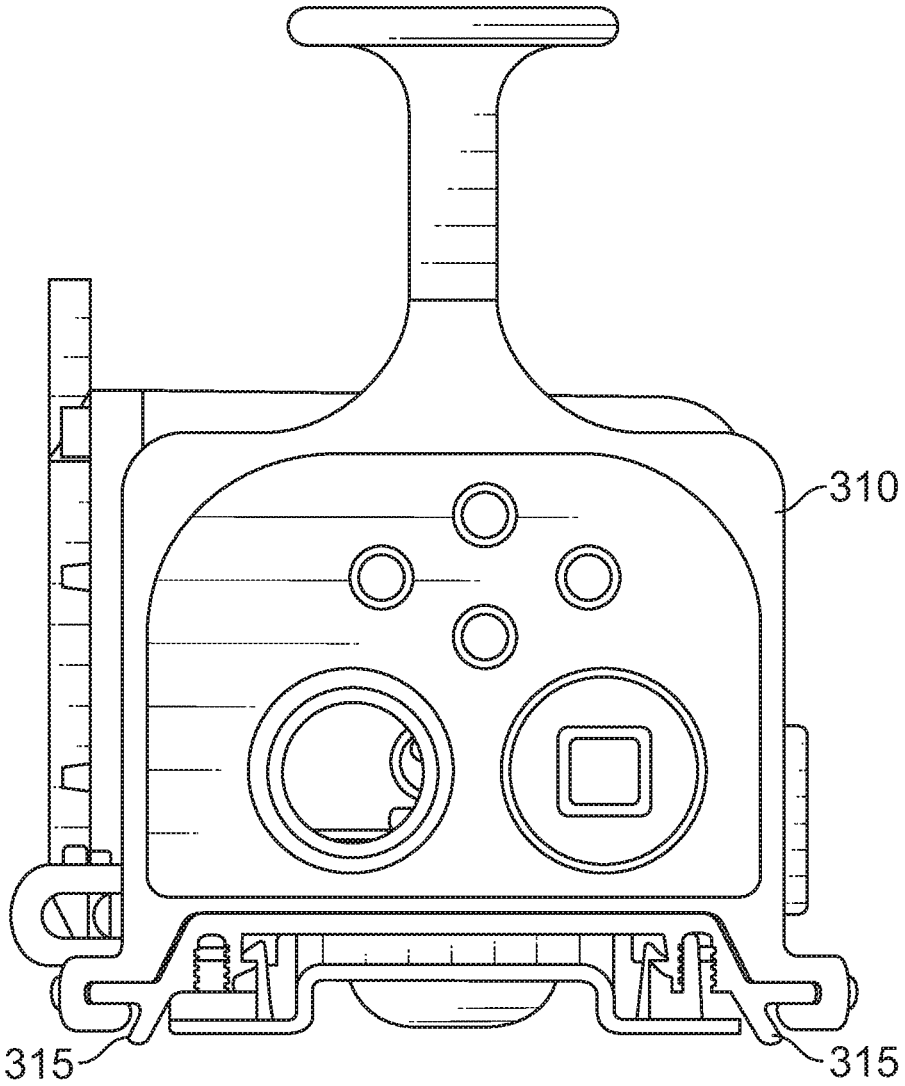
FIG. 8 illustrates a side view of the fixture of FIG. 7 depicting rails for the bracket of FIG. 7.

Referring to FIG. 7 and FIG. 8, in another embodiment, the mounting arrangement 200 comprises another bracket 310 for suspending the fixture 205 which is slidably mounted on rails 315 arranged on the holding plate 230 of the fixture 205. In an embodiment, the arrangement 200 comprises either the mounting bracket 300 or the mounting bracket 310.

The foregoing description of the embodiments has been provided for purposes of illustration and not intended to limit the scope of the present disclosure. Individual components of a particular embodiment are generally not limited to that particular embodiment, but, are interchangeable. Such variations are not to be regarded as a departure from the present disclosure, and all such modifications are considered to be within the scope of the present disclosure.

TECHNICAL ADVANCEMENTS

The present disclosure described herein above has several technical advantages including, but not limited to, the realization of a mounting arrangement for a lighting fixture that:

- facilitates secure mounting of a fixture to an overhead support;
- safeguards external elements of a fixture;
- ensures safety of personnel working on floor;

is easy to handle while mounting; and securely holds the fixture during maintenance.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The use of the expression "at least" or "at least one" suggests the use of one or more elements or ingredients or quantities, as the use may be in the embodiment of the disclosure to achieve one or more of the desired objects or results.

Any discussion of devices or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. A mounting arrangement (200) for a lighting fixture (205), said mounting arrangement (200) comprising:

a. a holding plate (230) having a first end (230*a*) and a second end (230*b*);

b. a first hole (210) configured near said first end (230*a*);

c. a second hole (215) configured near said second end (230*b*);

d. a wiring and driver compartment (245) fastened to an operative top surface of said holding plate (230);

e. a first extension (250) defining a third hole (250*a*), and a second extension (255) defining a fourth hole (255*a*), said first and second extensions (250 and 255) provided on either side of said compartment (245) and extending along the length of said holding plate (230);

f. a third extension (260) extending operatively vertically from a front wall of said wiring and driver compartment (245), said third extension (260) defining a fifth hole (260*a*) therein; and g. a first (235) removably threaded through said first hole (210), said third hole (250*a*), and said fifth hole (260*a*) to form a first loop (265*a*) for securing to and hanging said lighting fixture (205) from an overhead support structure (240).

2. The mounting arrangement (200) for a lighting fixture (205) as claimed in claim 1, wherein one end of said first rope (235) is configured in the form of an eye-loop.

3. The mounting arrangement (200) for a lighting fixture (205) as claimed n claim 1, wherein said first ropes (235) forms a second loop (265*b*) around said support structure (240) for gripping said support structure (240).

4. The mounting arrangement (200) for a lighting fixture (205) as claimed in claim 1, wherein a plurality of fins is configured on said wiring and driver compartment (245) for dissipating heat generated by the driver.

5. The mounting arrangement (200) for a lighting fixture (205) as claimed in claim 1, wherein said lighting fixture (205) comprises rails (315) provided on the operative bottom surface of said holding plate (230), said rails (315) are configured to receive linearly re-locatable sliding brackets (310) for suspending said fixture (205).

6. The mounting arrangement (200) for a lighting fixture (205) as claimed in claim 1, wherein a second rope (not shown in figures) similar to the first rope (235) is threaded through said second hole (215), said fourth hole (255*a*), and said fifth bole (260*a*) for securing and hanging said fixture (205) to said support structure (240).

7. The mounting arrangement (200) for a lighting fixture (205) as claimed in claim 6, wherein one end of said first rope (235) and said second rope includes a locking arrangement (270) in the form of locking rope-clip connected to it.

8. The mounting arrangement (200) for a lighting fixture (205) as claimed in claim 1, wherein a mounting bracket (300) is fitted on said compartment (245) in an offset manner from the center of said compartment (245), said mounting bracket (300) being pivoted to said compartment (245) along an axis parallel to the length of said holding plate (230).

9. The mounting arrangement (200) for a lighting fixture (205) as claimed in claim 8, wherein said mounting bracket (300) includes a plurality of curved slots (302) configured thereon to receive bolts pre-installed in said compartment (300).

10. The mounting arrangement (200) for a lighting fixture (205) as claimed in claim 9, wherein the material for said holding plate (230), said compartment (245) and said mounting bracket (300) is selected from the group consisting of aluminium and stainless steel.

* * * * *